US008337334B2

(12) United States Patent
Goodwin

(10) Patent No.: US 8,337,334 B2
(45) Date of Patent: Dec. 25, 2012

(54) GOLF BALLS WITH CLUSTERS OF DIMPLES HAVING NON-UNIFORM DIMPLE PROFILES

(75) Inventor: David A. Goodwin, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 596 days.

(21) Appl. No.: 12/559,146

(22) Filed: Sep. 14, 2009

(65) Prior Publication Data

US 2011/0065531 A1 Mar. 17, 2011

(51) Int. Cl.
*A63B 37/12* (2006.01)

(52) U.S. Cl. ..... 473/384

(58) Field of Classification Search ..... 473/378–385
See application file for complete search history.

(56) References Cited

U.S. PATENT DOCUMENTS

| | | | | |
|---|---|---|---|---|
| 2,002,726 | A | 5/1935 | Young | |
| 4,869,512 | A | 9/1989 | Nomura et al. | |
| 5,890,975 | A | 4/1999 | Stiefel | |
| 5,997,418 | A | 12/1999 | Tavares et al. | |
| 6,059,671 | A | 5/2000 | Asakura | |
| 6,176,793 | B1 | 1/2001 | Sullivan et al. | |
| 6,206,792 | B1 | 3/2001 | Tavares et al. | |
| 6,231,463 | B1 | 5/2001 | Tavares et al. | |
| 6,315,685 | B1 | 11/2001 | Tavares et al. | |
| 6,475,105 | B1 | 11/2002 | Murphy | |
| 6,478,698 | B2 | 11/2002 | Melvin et al. | |
| 6,503,158 | B2 | 1/2003 | Murphy et al. | |
| 6,527,654 | B2 | 3/2003 | Sajima | |
| 6,616,553 | B1 * | 9/2003 | Tavares | 473/384 |
| 6,695,721 | B1 | 2/2004 | Tavares et al. | |
| 2002/0119832 | A1 * | 8/2002 | Higuchi et al. | 473/367 |
| 2005/0046071 | A1 | 3/2005 | Endo et al. | |
| 2006/0116222 | A1 | 6/2006 | Sajima et al. | |
| 2006/0142098 | A1 | 6/2006 | Sajima et al. | |

FOREIGN PATENT DOCUMENTS

WO 00/48687 A1 8/2000

OTHER PUBLICATIONS

European Search Report in corresponding EPO Application, Application No. 10173552.0, issued Feb. 3, 2011.

* cited by examiner

*Primary Examiner* — Raeann Gorden
(74) *Attorney, Agent, or Firm* — Banner & Witcoff, Ltd.

(57) ABSTRACT

Golf balls include an exterior cover having a plurality of dimples arranged thereon, wherein from 5 to 95% of the dimples have a non-uniform dimple profile. At least a majority of the dimples having a non-uniform dimple profile on the golf ball body may be arranged in 2-24 repeating dimple clusters on the exterior surface of the ball. In some example structures, the exterior surface of the ball will include from 4-18 repeating dimple clusters, from 4-12 repeating dimple clusters, or even from 6-10 repeating dimple clusters.

36 Claims, 13 Drawing Sheets

GOLF BALLS WITH CLUSTERS OF DIMPLES HAVING NON-UNIFORM DIMPLE PROFILES

FIELD OF THE INVENTION

This invention relates generally to golf balls that include clusters of dimples having non-uniform dimple profiles and methods of making such balls.

BACKGROUND

Conventional golf balls include several dimples on their cover, e.g., to improve ball flight by providing lift to the ball and promoting establishment of a turbulent air flow (to reduce aerodynamic drag). While many different dimple types exist (e.g., different sizes, shapes, cross sectional profiles, etc.), most conventional dimples on conventional golf balls have a generally round perimeter or edge shape (e.g., a round appearance for the dimple edge or perimeter when viewed from above).

Also, conventional round dimples of the types described above also typically have a cross sectional profile such that the majority of the surface of the dimple (i.e., the areas of the dimple surface away from the very edge) corresponds to the arc of a circle. In other words, a conventional dimple will have the majority of its surface corresponding to a portion of a sphere. FIGS. 1A and 1B help illustrate this conventional design. As shown in FIG. 1A, in a conventional golf ball 10 design, all of the dimples 12 on the ball 10 (only a portion of which are shown) are arranged such that radial lines R running from the center C of the overall ball structure 10 will also intersect the center $C_d$ of each dimple. In other words, a radius R through the center C of the golf ball 100 will align with a radius $R_d$ of the spherical shape from which the majority of the dimple surface $S_d$ is formed.

FIG. 1B illustrates an individual conventional dimple 12 in greater detail (e.g., like the dimple 12 in the upper right portion of FIG. 1A). As shown in this figure, the center $C_d$ of the dimple surface $S_d$ (as shown by the location of the dimple tangent line $T_d$) and the ball tangent line $T_b$ centered over that dimple (assuming that the ball surface S is a perfect sphere without dimples) are aligned such that a single line passes through both the ball center C (shown in FIG. 1A and not in FIG. 1B) and the dimple center $C_d$ at the ball and dimple tangent points. In other words, in this conventional ball design 10, the dimple(s) 12 are symmetrically oriented such that the dimple radius $R_d$ (through its center point $C_d$) extends in the same direction as a radial axis R from the dimple center $C_d$ and through the ball center point C. Notably, in this illustrated arrangement, the dimple tangent line $T_d$ is parallel to the ball tangent line $T_b$. This highly symmetrical and aligned type of dimple structure, as used herein, may be referred to as a "tangential dimple" or a "conventional dimple." Often, all dimples on a given golf ball structure will have this tangential or conventional dimple orientation.

While these conventional dimple structures provide known aerodynamic effects on golf ball structures, there is room for improvement in the art. For example, by providing non-uniform dimple designs, dimple profiles, and dimple patterns on a golf ball, the lift, drag, and other aerodynamic properties of a golf ball structure can be altered and controlled.

SUMMARY

The following presents a general summary of aspects of this invention in order to provide a basic understanding of at least some aspects of the invention. This summary is not intended as an extensive overview of the invention. It is not intended to identify key or critical elements of the invention or to delineate the scope of the invention. The following summary merely presents some concepts of the invention in a general form as a prelude to the more detailed description provided below.

Aspects of this invention relate generally to golf ball structures that include: a golf ball body including a cover having a plurality of dimples arranged on an exterior surface thereof, wherein from 5 to 95% of the dimples have a non-uniform dimple profile. In such structures, at least a majority of the dimples having a non-uniform dimple profile on the golf ball body may be arranged in 2-24 repeating dimple clusters on the exterior surface of the ball. In some examples of this invention, the exterior surface of the ball will include from 4-18 repeating dimple clusters, from 4-12 repeating dimple clusters, or even from 6-10 repeating dimple clusters.

Additional aspects of this invention relate to methods of producing golf balls of the types described above. Such methods may include: (a) forming a golf ball interior; and (b) forming a cover to enclose the golf ball interior, wherein the cover is formed to include a plurality of dimples arranged on an exterior surface thereof, wherein from 5 to 95% of the dimples have a non-uniform dimple profile, and wherein at least a majority of the dimples having a non-uniform dimple profile on the golf ball body are arranged in 2-24 repeating dimple clusters on the exterior surface.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

Figure 1A:
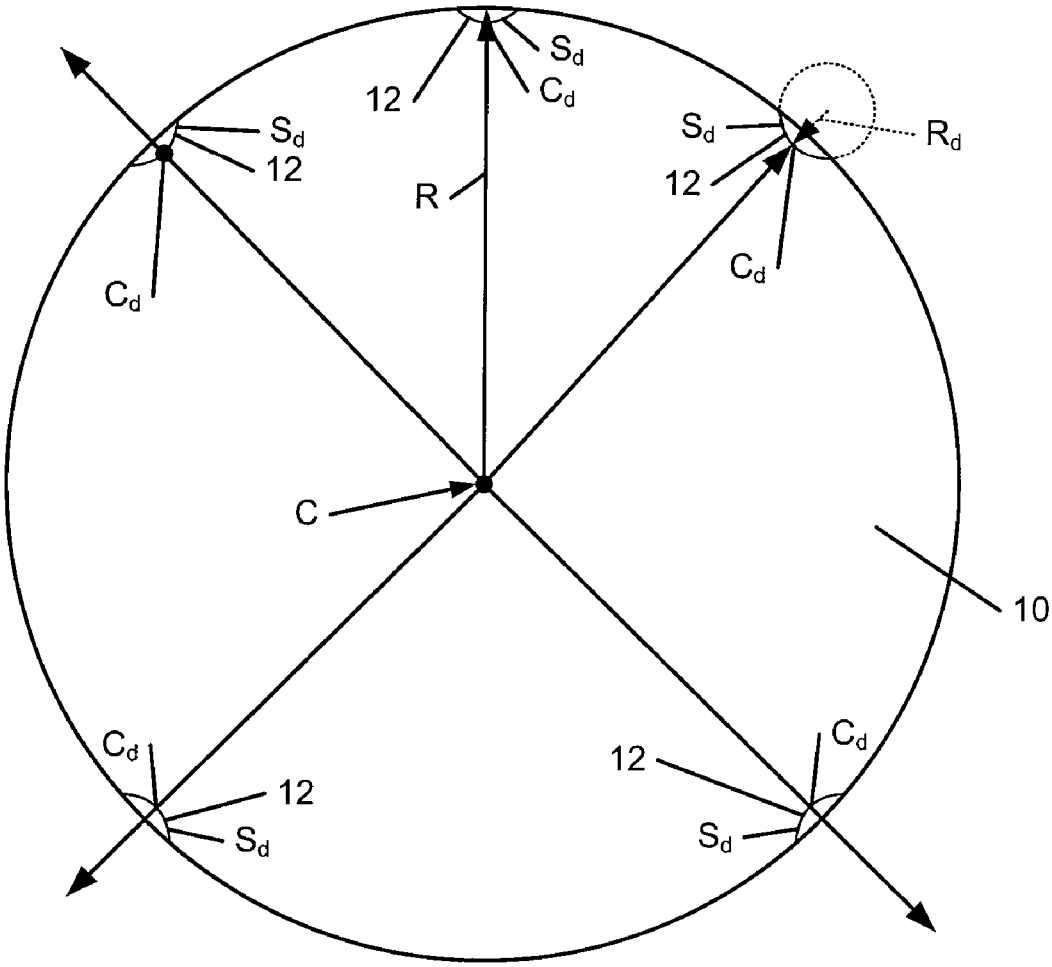
FIG. 1A (Prior Art)
FIGS. 1A and 1B illustrate features of conventional or "uniform" dimple structures as are known and used in the art.

In the following description of various examples of the invention, reference is made to the accompanying drawings, which form a part hereof, and in which are shown by way of illustration various example systems and environments in which aspects of the invention may be practiced. It is to be understood that other specific arrangements of parts, example systems, components, and environments may be utilized and structural and functional modifications may be made to the described arrangements and systems without departing from the scope of the present invention. Also, while the terms "top," "bottom," "side," "front," "back," "above," "below," "under," "over," and the like may be used in this specification to describe various example features and elements of the invention, these terms are used herein as a matter of convenience, e.g., based on the example orientations shown in the figures and/or a typical orientation during a typical use. Nothing in this specification should be construed as requiring a specific three dimensional orientation of structures in order to fall within the scope of this invention.

In this specification, various golf ball structures are described in which "non-uniform dimples" are arranged in a plurality of "clusters" on the golf ball surface. A "non-uniform dimple," as that term is used herein, unless otherwise noted or clear from the context, means dimples having a cross sectional shape (when cut through the center of the dimple in the radial direction of the ball) that is not symmetric about the center point of the dimple. Some "non-uniform dimples" will be shaped so as to have: (a) a deeper and/or steeper half and (b) a shallower and/or more gently sloped half. The deeper and/or steeper half may be visually discernible on at least some dimple structures in accordance with examples of this invention. Other "non-uniform dimples" may have internal bumps or other structures within the dimple.

To be include in a "cluster," a non-uniform dimple must be located immediately adjacent at least one other non-uniform dimple of the same or of a different structure. To be considered "immediately adjacent," a first non-uniform dimple must be located with respect to a second non-uniform dimple such that a straight line or arc along the surface of the ball between the first dimple and the second dimple can be drawn that does not intersect another dimple. The "cluster" corresponds to all of the non-uniform dimples located within an unbroken chain of "immediately adjacent" non-uniform dimples. If desired, the "cluster" may be repeated at various locations on a ball structure.

A. General Description of Example Golf Ball Structures and Example Methods of Making Golf Balls According to the Invention Golf ball structures in accordance with at least some examples of this invention may include: a golf ball body including a cover having a plurality of dimples arranged on an exterior surface thereof, wherein from 5 to 95% of the dimples have a non-uniform dimple profile. In such structures, at least a majority of the dimples having a non-uniform dimple profile on the golf ball body may be arranged in 2-24 repeating dimple clusters on the exterior surface of the ball. In some examples of this invention, the exterior surface of the ball will include from 4-18 repeating dimple clusters, from 4-12 repeating dimple clusters, or even from 6-10 repeating dimple clusters.

In at least some golf ball structures in accordance with examples of this invention, the golf ball body will include a first pole, a second pole opposite the first pole, and an equator evenly spaced between the first and second poles so as to divide the golf ball body into a first hemisphere including the first pole and a second hemisphere including the second pole. In such structures, one half (or some other proportion) of the repeating dimple clusters may be located on the first hemisphere and the other half (or some other proportion) of the repeating dimple clusters may be located on the second hemisphere. If desired, the repeating dimple clusters in each hemisphere will be symmetrically arranged with respect to the pole of that hemisphere, and the clusters in one hemisphere may align with or be staggered from the clusters in the other hemisphere (e.g., such that the centers of the dimple clusters in the first hemisphere do not align with the centers of the dimple clusters in the second hemisphere along any great circle extending between the first and second poles). If desired, each hemisphere may include from 2-9 repeating dimple clusters, from 2-6 repeating dimple clusters, or even from 3-5 repeating dimple clusters. Also, if desired, a single hemisphere may include two or more different dimple cluster arrangements that optionally may be repeated around that hemisphere of the golf ball surface.

In some golf ball structures in accordance with examples of this invention, the golf ball surface will include: (a) a first hemisphere with N dimple clusters having their centers arranged 360/N degrees apart with respect to a circumferential direction around a first pole of the ball, and (b) a second hemisphere with M dimple clusters having their centers arranged 360/M degrees apart with respect to a circumferential direction around a second pole of the ball, wherein N=M and wherein N and M are integers between 2 and 20. If desired, the centers of the dimple clusters in the first hemisphere may be arranged 360/2N degrees apart from the centers of the dimple clusters in the second hemisphere with respect to the circumferential direction of the ball. In some structures, N and M may be integers between 2 and 12, or even integers between 2 and 8.

A golf ball structure may have two or more clusters of dimples having different non-uniform dimple patterns or arrangements. The various dimple clusters on a given golf ball structure may have the same number of dimples having a non-uniform dimple profile or different numbers of dimples having a non-uniform dimple profile. Each dimple cluster may include, for example, from 2 to 36 dimples having a non-uniform dimple profile, and in some examples, from 4 to 30 dimples having a non-uniform dimple profile, from 6 to 24 dimples having a non-uniform dimple profile, or even from 8 to 20 dimples having a non-uniform dimple profile. In some more specific example structures according to this aspect of the invention, wherein the golf ball body includes a first pole, a second pole opposite the first pole, and an equator evenly spaced between the first and second poles so as to divide the golf ball body into a first hemisphere including the first pole and a second hemisphere including the second pole, the first hemisphere may include a first dimple cluster having a first dimple cluster pattern arrangement and a second dimple cluster having a second dimple cluster pattern arrangement that differs from the first dimple cluster pattern arrangement, and the second hemisphere may include a third dimple cluster having the first dimple cluster pattern arrangement and a fourth dimple cluster having the second dimple cluster pattern arrangement. Additional dimple cluster pattern arrangements also may be provided in such structures, if desired.

A variety of arrangements of the dimple clusters are possible without departing from this invention. For example, in a golf ball structure that includes a first pole, a second pole opposite the first pole, and an equator evenly spaced between the first and second poles so as to divide the golf ball body into a first hemisphere including the first pole and a second hemisphere including the second pole, the dimple clusters may be arranged such that none of the clusters containing dimples having a non-uniform dimple profile extends across the equator. Alternatively, if desired, the dimple clusters may be arranged such that at least two of the clusters containing dimples having a non-uniform dimple profile extend across the equator. In some structures, at least four clusters or even at least six clusters containing dimples having a non-uniform dimple profile will extend across the equator.

As noted above (and as will be described in more detail below), the non-uniform dimples may be structured such that the dimple profile or cross section includes a deep and/or steep side and a shallow and/or more gently sloped side. In such structures, the dimple profiles may be arranged on the ball in a variety of different manners. For example, if desired, the non-uniform dimples in a cluster may be arranged such that the dimple profiles are aligned with one another (e.g., with the steep sides of adjacent non-uniform dimples pointing the same direction) or the non-uniform dimples in a cluster may be arranged such that the dimple profiles are oriented facing opposite directions (e.g., with the steep sides of adjacent non-uniform dimples pointing in opposing directions). As additional examples, if desired, the non-uniform dimples in a cluster may be arranged such that: (a) the shallow side of each dimple having a non-uniform dimple profile is arranged so as to be closest to a geometric center of the dimple cluster in which it is contained or (b) the deep side of each dimple having a non-uniform dimple profile is arranged so as to be closest to a geometric center of the dimple cluster in which it is contained. As another example, if desired, for each dimple cluster, one half (or some other portion) of the dimples having a non-uniform dimple profile in the dimple cluster may be arranged to have their shallow side closest to a geometric center of the dimple cluster and the other half (or the remaining portion) of the dimples having a non-uniform dimple profile in the dimple cluster may be arranged to have their deep side closest to the geometric center of the dimple cluster.

Any desired dimple cluster arrangements may be provided without departing from this invention. As some more specific examples, the dimple clusters including non-uniform dimples may be arranged in a polygonal configuration having from 3-20 sides, such as in a generally overall triangular configuration, a generally overall square or rectangular configuration, a generally pentagonal configuration, a generally hexagonal configuration, and a generally octagonal configuration, etc. In other cluster arrangements, a continuous chain of three to ten immediately adjacent non-uniform dimples will surround one or more dimples having a uniform or conventional dimple profile. In some more specific example structures of this type, a continuous chain of five dimples having a non-uniform dimple profile surround one or two conventional dimples, or a continuous chain of six dimples having a non-uniform dimple profile surround one or two conventional dimples.

An individual cluster may contain both non-uniform and uniform (or conventional) dimples. While a cluster may contain any numbers of non-uniform and uniform dimples, in at least some example structures in accordance with this invention, at least 30% of the dimples within an individual cluster will be non-uniform dimples, and in some examples, at least 50%, at least 75%, or even at least 90% of the dimples may be non-uniform. If desired, 100% of the dimples within a cluster may be non-uniform dimples.

A golf ball in accordance with examples of this invention may include any desired number of overall dimples (uniform and non-uniform), such as from 200 to 800 total dimples. The percentage of non-uniform dimples on the ball (with respect to the total number of dimples on the ball), may range from 10% to 90%, from 20% to 80%, or even from 30% to 70%. In absolute numbers, the number of non-uniform dimples on the ball structure may range from 20 to 720, and in some example structures, from 24 to 432, from 48 to 384, or even from 72 to 336. For dimples that have a surface portion following the arc of a circle (both uniform and non-uniform dimples), the dimple radius may be in the range from 3 mm to 26 mm, and in some examples from 4 mm to 24 mm, from 4 mm to 20 mm, or even from 5 mm to 16 mm. Overall dimple diameters (both uniform and non-uniform dimples) may vary broadly, for example, from 1 mm to 8 mm, and in some examples, from 1.5 mm to 6 mm, or even from 2 mm to 5 mm. Overall dimple depths at the deepest location on the dimple also may vary broadly, such as from 0.05 mm to 0.5 mm, and in some examples, from 0.075 mm to 0.4 mm, or even from 0.1 mm to 0.3 mm.

As some more specific examples, aspects of this invention relate to golf balls including: (a) a core having one or more individual parts; and (b) a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole. In the first hemisphere, the cover member includes 3-5 repeating non-uniform dimple clusters arranged around the first pole; wherein each non-uniform dimple cluster in the first hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end. In the second hemisphere, the cover member includes 3-5 repeating non-uniform dimple clusters arranged around the second pole, wherein each non-uniform dimple cluster in the second hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end. At least one of the 3-5 non-uniform dimple clusters in the first hemisphere is arranged in a first pattern and at least one of the 3-5 non-uniform dimple clusters in the second hemisphere is arranged in the first pattern. The non-uniform dimple clusters may have any of the arrangements and/or orientations described above (and those described in more detail below).

Additional aspects of this invention relate to methods of producing golf balls of any of the various types described above. Such methods may include, for example: (a) forming a golf ball interior (e.g., including a solid core having one or more independent layers, a thread wound core, a liquid-containing or gel-containing core, etc.); and (b) forming a cover to enclose the golf ball interior, wherein the cover is formed to include a plurality of dimples arranged on an exterior surface thereof, wherein from 5 to 95% of the dimples have a non-uniform dimple profile, and wherein at least a majority of the dimples having a non-uniform dimple profile on the golf ball body are arranged in 2-24 repeating dimple clusters on the exterior surface. The cover may include any one or more of the various features or characteristics described in more detail above (and/or features or characteristics described in more detail below).

As some more specific examples, additional aspects of this invention include methods of forming golf balls that include: (a) forming a core including one or more individual parts; and (b) forming a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole. In the first hemisphere, the cover member is formed to include 3-5 repeating non-uniform dimple clusters arranged around the first pole; wherein each non-uniform dimple cluster in the first hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end. In the second hemisphere, the cover member is formed to include 3-5 repeating non-uniform dimple clusters arranged around the second pole, wherein each non-uniform dimple cluster in the second hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end. At least one of the 3-5 non-uniform dimple clusters in the first hemisphere is arranged in a first pattern and at least one of the 3-5 non-uniform dimple clusters in the second hemisphere is arranged in the first pattern. The non-uniform dimple clusters may be formed to include any of the arrangements and/or orientations described above (and those described in more detail below).

The ball interiors and/or covers may be formed in any desired manner without departing from this invention, including in conventional manners that are known and used in the art, such as by casting the layers, by molding the various layers (e.g., injection molding), etc. The molds or other structures for forming the cover layers to include the non-uniform dimples may be produced in any desired manner without departing from this invention, including through the use of molding, casting, machining, grinding, or other techniques, including through the use of precision grinding equipment for producing golf ball cover cavities, as are known and used in the art. Such grinding equipment may be computer controlled and programmed to cut the various desired dimple pattern arrangements into the interior cavity of the mold structure, in a manner that is known and conventionally used in the art.

B. Specific Examples of the Invention

The various figures in this application illustrate examples of various golf ball structures and methods of making such golf ball structures according to examples of this invention. When the same reference number appears in more than one drawing, that reference number is used consistently in this specification and the drawings to refer to the same or similar parts throughout.

Figure 2A:
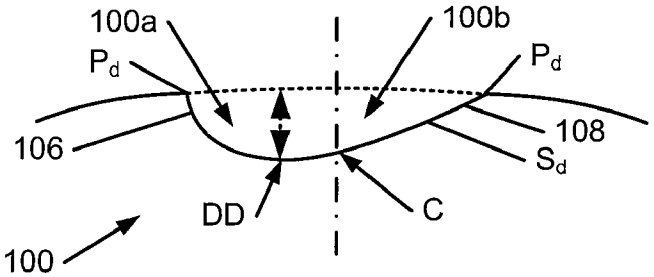
FIGS. 2A through 2D illustrate example features of non-uniform dimples in accordance with at least some examples of this invention.
Figure 2B:
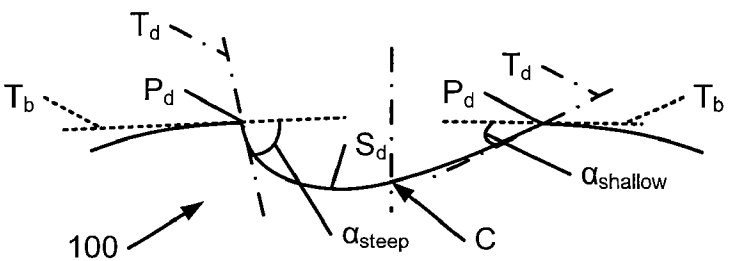
Figure 1B:
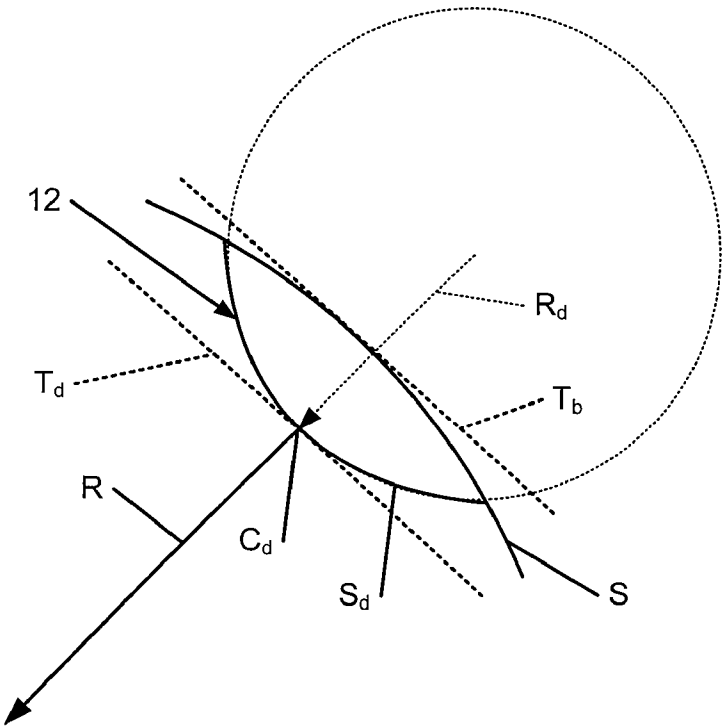
FIG. 1B (Prior Art)
Figure 2D:
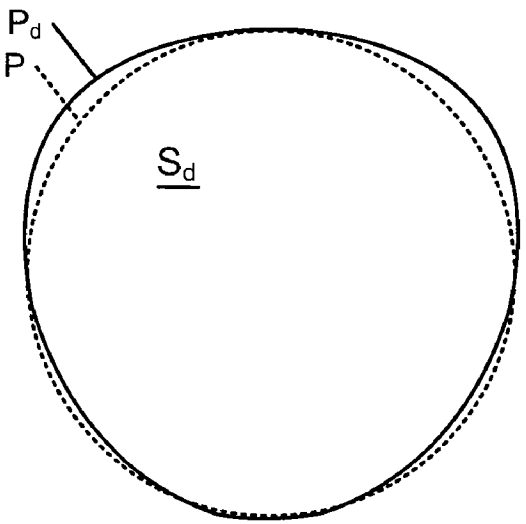
Figure 2C:
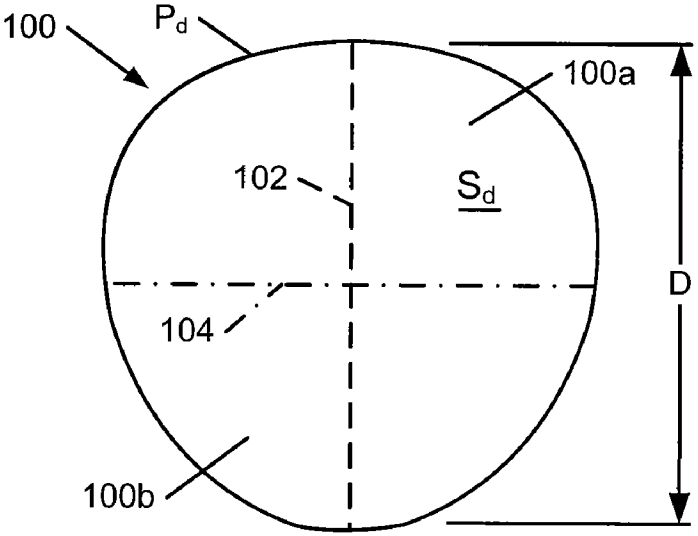

As noted above, aspects of this invention relate to golf ball structures having clusters of non-uniform dimples. FIGS. 2A through 2D illustrate one example of a non-uniform dimple structure 100 that may be used in accordance with at least some examples of this invention. FIGS. 2A and 2B illustrate a cross-section profile of this non-uniform dimple example 100 to show various features (taken along axis 102 in FIG. 2C), FIG. 2C illustrates an overhead view of this non-uniform dimple example 100 (e.g., when viewed looking at the ball exterior), and FIG. 2D illustrates how the edge or perimeter $P_d$ this example non-uniform dimple structure 100 differs from the edge or perimeter P a conventional round dimple structure (shown in broken lines in FIG. 2D). As shown in these figures, the dimple surface $S_d$ is formed in the ball structure such that the dimple 100 is symmetric across one axis 102 (e.g., a mirror image) and asymmetric across the perpendicular axis 104 thereto.

Moreover, as best illustrated in FIGS. 2A and 2B, the non-uniform dimple 100 defines a surface structure $S_d$ in which one half 100*a* of the dimple 100 (i.e., the left half in FIGS. 2A and 2B and the upper half 100*a* above axis 104 in FIG. 2C) includes a relatively deep and/or steeply sloped edge entry angle or surface 106 and the other half 100*b* (i.e., the right half in FIGS. 2A and 2B and the lower half 100*b* below axis 104 in FIG. 2C) includes a relatively shallow and/or gently sloped edge entry angle or surface 108. As shown in FIG. 2B, the entry angles $\alpha_{steep}$ and $\alpha_{shallow}$ may be measured as the angle between: (a) a tangent $T_b$ to the golf ball surface at the dimple edge $P_d$ location (assuming the ball is a perfect sphere without dimples) and (b) a tangent $T_d$ to the actual dimple surface $S_d$ at the dimple edge location $P_d$. In making these measurements, the edge locations $P_d$ should be located adjacent to the steepest and shallowest slopes on the dimple structure (e.g., at the intersections of axis 102 and the dimple perimeter $P_d$ in the example structure illustrated in FIGS. 2A through 2D). In some example structures in accordance with this invention, the entry angle $\alpha_{steep}$ will be greater than the entry angle $\alpha_{shallow}$ and may be within the range of 20° to 120° (and in some examples, within the range of 30° to 90° or even within the range of 40° to 60°), and the entry angle $\alpha_{shallow}$ will be less than the entry angle $\alpha_{steep}$ and may be within the range of 10° to 80° (and in some examples, within the range of 15° to 75° or even within the range of 20° to 50°). Also, in this dimple structure 100, as shown in FIG. 2A, the deepest dimple depth DD is located away from the dimple's geometric center C and in dimple half 100*a*.

As illustrated in FIGS. 2C and 2D, the dimple perimeter edge $P_d$ of this example structure may be somewhat out of round. More specifically, in this example structure, using axes 102 and 104 as the geometric center lines for the dimple, the upper half 100*a* of the dimple structure 100 is somewhat larger than a circle structure (as shown by dashed lines in FIG. 2D) oriented at the geometric center of the dimple 100 and having a diameter D corresponding to the length of axes 102 and 104 (which have the same length in this example structure 100), and the lower half 100*b* of the dimple structure 100 is somewhat smaller than this same circle structure.

Figure 3A:
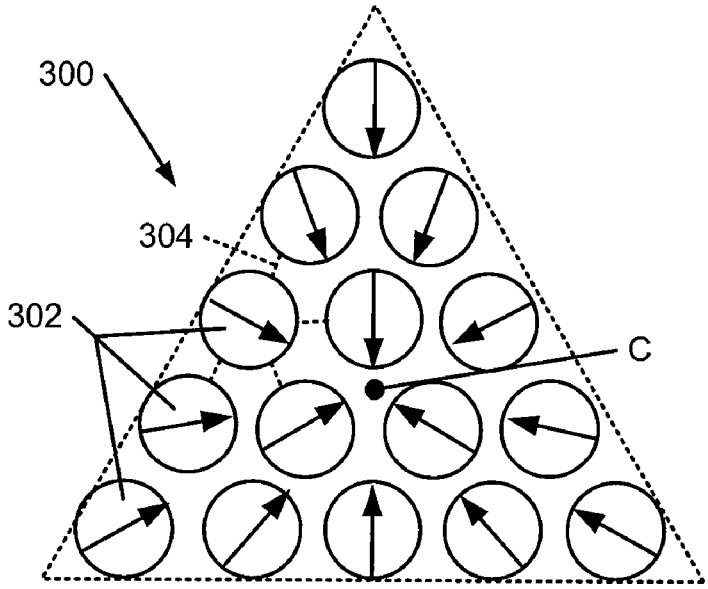
FIGS. 3A through 3D illustrate one example of a generally triangular dimple cluster arrangement in accordance with this invention.
Figure 3B:
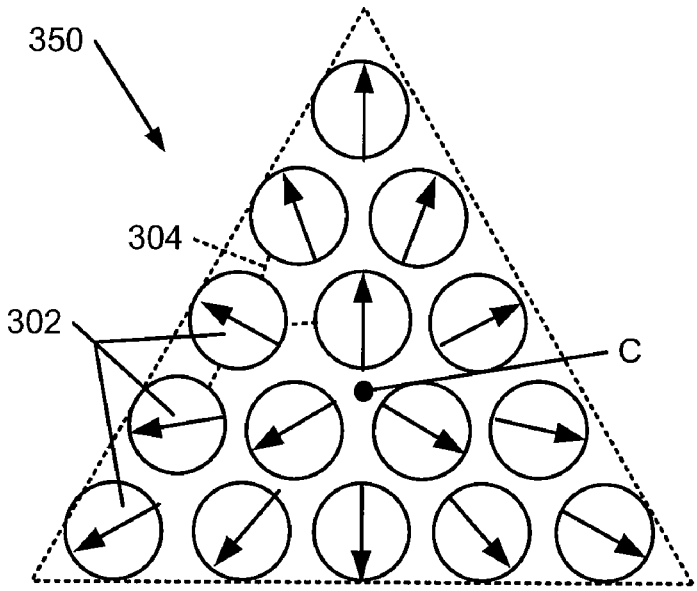
Figure 3C:
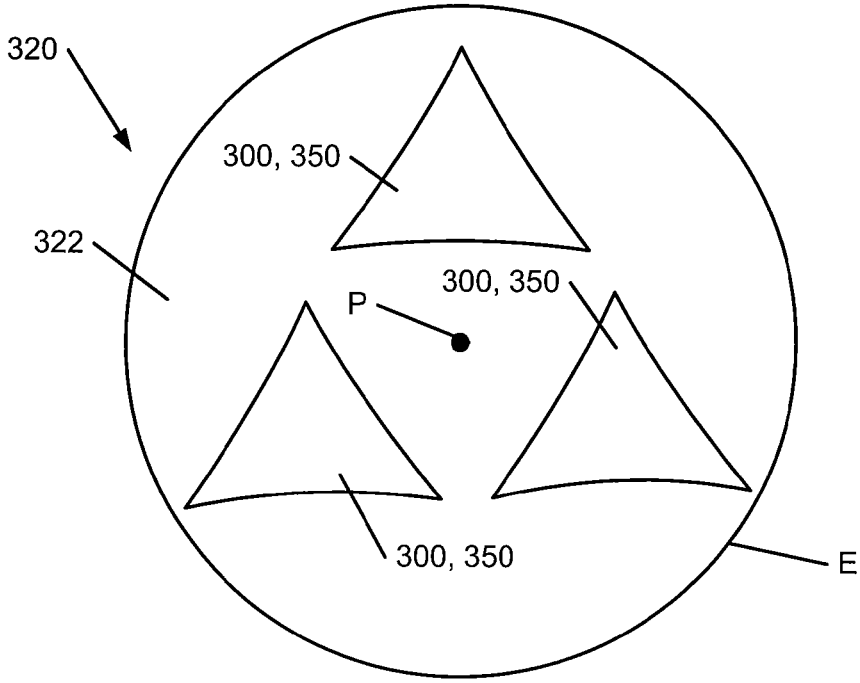
Figure 3D:
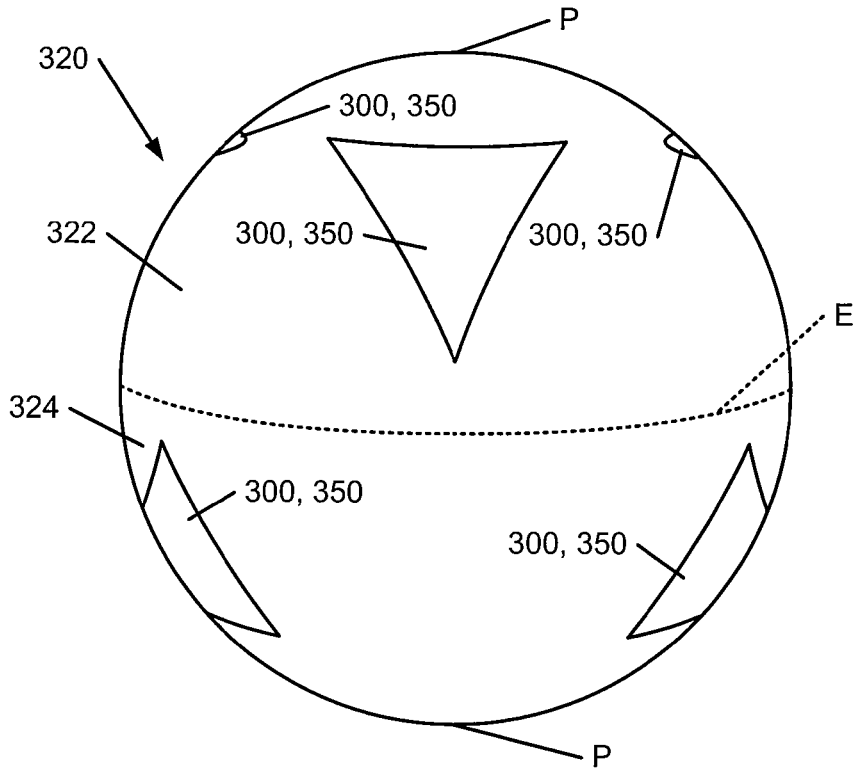

Example non-uniform dimple clusters in accordance with this invention will be described beginning with FIGS. 3A through 3D. FIGS. 3A and 3B illustrate examples of individual non-uniform dimple clusters 300 and 350, respectively, while FIGS. 3C and 3D illustrate an example of an arrangement of a plurality of at least one of these non-uniform dimple clusters 300, 350 on a golf ball 320. As shown in FIG. 3A, this non-uniform dimple "cluster" includes plural non-uniform dimples 302 located immediately adjacent at least one other non-uniform dimple 302. Notably, in the cluster shown in FIG. 3A, each non-uniform dimple 302 is located such that it may be connected with at least one other non-uniform dimple 302 by a straight line or arc 304 along the surface of the ball without intersecting a uniform or conventional dimple. The "cluster" 300 in this illustrated example corresponds to all of the non-uniform dimples 302 located within an unbroken chain of "immediately adjacent" non-uniform dimples 302, which generally forms a triangular arrangement of dimples. In this illustrated example, all dimples of the "cluster" are non-uniform dimples 302 (in the drawings included herewith, the non-uniform dimples are distinguished from uniform or conventional dimples by an arrow element (e.g., extending along axis 102 shown in FIG. 2C, in this example), wherein the arrowhead points to the shallow half of the dimple 302 (toward shallow half 100*b* shown in FIG. 2C)), and each dimple cluster 300 includes 15 total non-uniform dimples 300. Notably, in the arrangement shown in FIG. 3A, the non-uniform dimples 302 are arranged so that their axes 102 and their shallow halves 100*b* are oriented to point toward the geometric center C of the dimple cluster 300. Optionally, if desired, the center C may be defined by a dimple, either a uniform, conventional dimple or a non-uniform dimple that may be included within the overall cluster arrangement 300.

FIG. 3B shows another dimple cluster arrangement 350 that is similar to the arrangement 300 shown in FIG. 3A. In the arrangement 350 shown in FIG. 3B, however, the non-uniform dimples 302 are arranged so that their axes 102 and their shallow halves 100*b* are oriented to point directly away from the geometric center C of the dimple cluster 350. Optionally, if desired, the center C may be defined by a dimple, either a uniform, conventional dimple or a non-uniform dimple.

FIGS. 3C and 3D illustrate an example arrangement of the dimple clusters 300 and/or 350 on a golf ball 320. Golf balls 320 may be considered as having two opposite poles P, one at the top of the ball 320 and one at the bottom of the ball 320, and an equator E corresponding to a great circle situated midway between the poles P that divides the ball 320 into an upper hemisphere 322 and a lower hemisphere 324. While not a requirement, the poles P may correspond to the uppermost and lowermost tangents of a mold structure used to create the balls 320 (and particularly to the molds for forming the ball cover), and the equator E may correspond to the parting line between the two mold halves. In other structures, the poles P and equator E may be located at other locations on the ball vis-à-vis the ball producing mold structures (e.g., the equator E need not correspond to the mold parting line, particularly for molds used in making "seamless" balls). As shown in the top view of FIG. 3C, the dimple clusters 300, 350 may be arranged such that they are symmetrically or evenly spaced around the pole P. The bottom view (not shown) will look similar to the top view. Furthermore, as shown in the front view of FIG. 3D, the dimple clusters 300, 350 may be arranged such that the dimple clusters 300, 350 in the top hemisphere 322 (e.g., the geometric centers of the dimple clusters 300, 350) do not align with the dimple clusters 300, 350 in the bottom hemisphere 324 (e.g., the geometric centers of the dimple clusters 300, 350). Rather, as shown in FIG. 3D, the dimple clusters 300, 350 in the bottom hemisphere 324 may be staggered with respect to the dimple clusters 300, 350 in the top hemisphere 322 such that the overall dimple cluster arrangements 300, 350 are symmetrically arranged about the center of the golf ball 320.

All of the dimple clusters on a given ball may have the same overall non-uniform dimple count, structure, and orientation, or any one or more of these features may differ without departing from this invention. In at least some example ball structures in accordance with this invention, the various non-uniform dimple clusters will be arranged in an overall symmetrical manner over the entirety of the ball surface with respect to the ball's center point. The non-uniform dimple clusters 300, 350 may be arranged such that the exterior-most non-uniform dimples are surrounded outside the clusters 300, 350 by only uniform or conventional dimples. For purposes of clarity and to better illustrate the dimple cluster arrangements on the ball 320, the individual dimples are not shown in FIGS. 3C and 3D.

Also, golf ball structures in accordance with examples of this invention may have any desired number of non-uniform dimple clusters arranged around the ball's poles P without departing from this invention. As a more specific example, if desired, each hemisphere may include from 2-9 repeating dimple clusters, and in some examples, from 2-6 repeating dimple clusters, or even from 3-5 repeating dimple clusters. A single hemisphere may include two or more different dimple cluster arrangements that optionally may be repeated around that hemisphere of the golf ball surface.

In some golf ball structures in accordance with examples of this invention, the top hemisphere 322 will include N dimple clusters 300, 350 having their centers arranged 360/N degrees apart with respect to a circumferential direction around the top pole P of the ball 320, and the bottom hemisphere 324 will include M dimple clusters 300, 350 having their centers arranged 360/M degrees apart with respect to a circumferential direction around the bottom pole P of the ball 320, wherein N=M and wherein N and M are integers between 2 and 20. If desired, the centers of the dimple clusters 300, 350 in the top hemisphere 322 may be arranged 360/2N degrees apart from the centers of the dimple clusters 300, 350 in the bottom hemisphere 324 with respect to the circumferential direction around the ball. In some structures, N and M may be integers between 2 and 12, or even integers between 2 and 8.

Figure 4A:
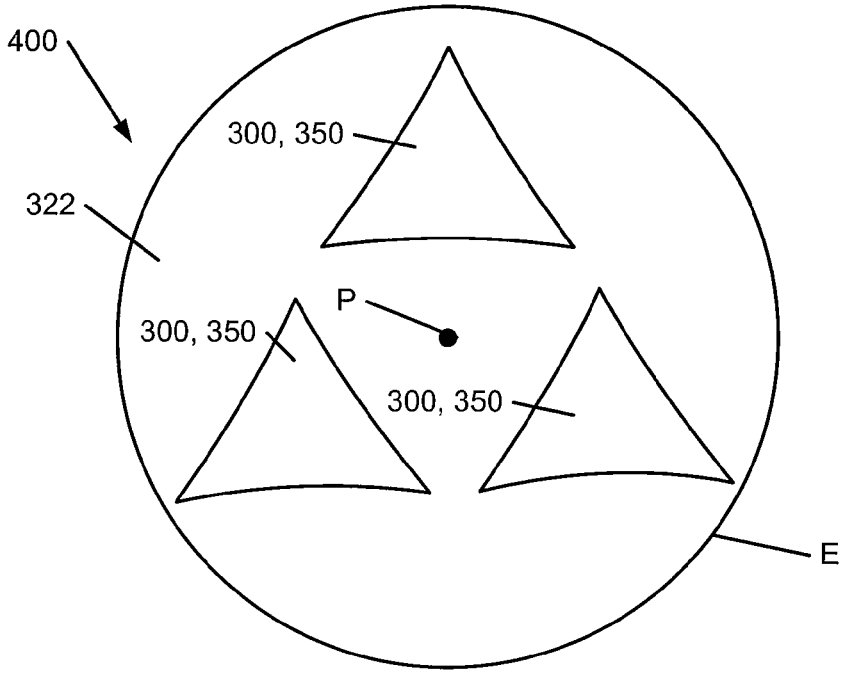
FIGS. 4A and 4B illustrate another example of a generally triangular dimple cluster arrangement on a golf ball in accordance with this invention.
Figure 4B:
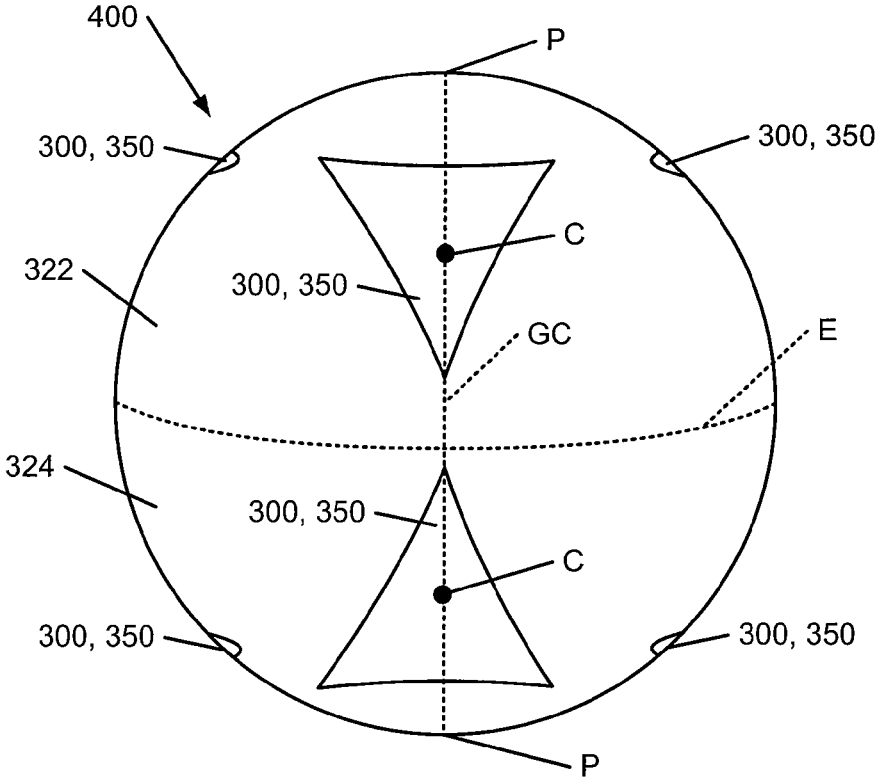

FIGS. 4A and 4B show a top view and a front view, respectively, of an alternative dimple cluster arrangement on a golf ball structure 400 that may be used in accordance with at least some examples of this invention. In this example ball structure 400, the centers C of at least two of the dimple clusters 300, 350 are aligned along a great circle GC extending between the top pole P and the bottom pole P. Each dimple cluster 300, 350 pair (i.e., one in the top hemisphere 322 and one in the bottom hemisphere 324) will be aligned in the manner shown. In this ball structure 400, the various dimple clusters 300, 350 will be arranged symmetric about the ball's center point.

As noted above, in the specific dimple cluster arrangements of FIGS. 3A through 4B, all of the dimples in a given cluster may be non-uniform dimples. This is not a requirement. Rather, if desired, at least some of the dimples within a cluster may be conventional or uniform dimples. FIGS. 5 through 9 illustrate some examples of such dimple cluster arrangements, and these dimple cluster arrangements will be described in more detail below.

Figure 5:
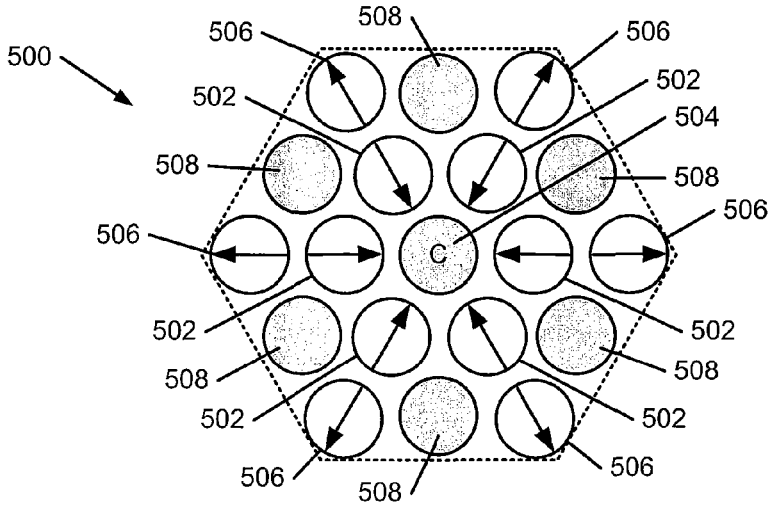
FIGS. 5 through 7 illustrate examples of generally hexagonal dimple cluster arrangements in accordance with this invention.
Figure 6:
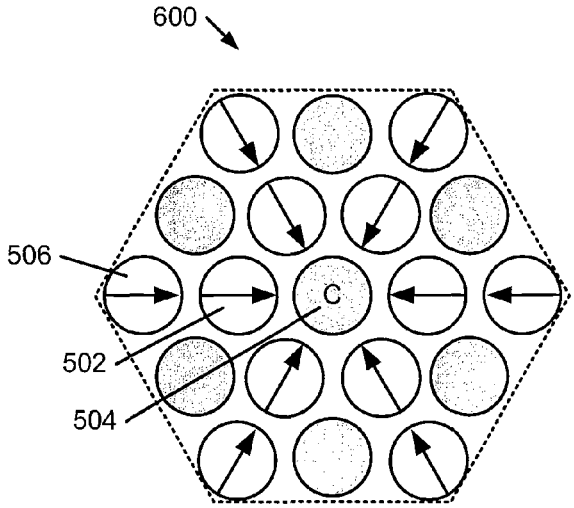
Figure 7:
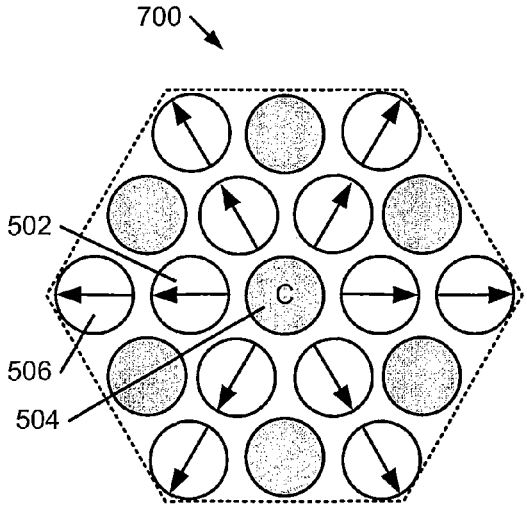

As shown in FIGS. 5 through 7, these dimple cluster arrangements 500, 600, and 700 have a series of six non-uniform dimples 502 arranged immediately adjacent one another and surrounding a central dimple 504 (e.g., a uniform or conventional dimple). Each of the interior-most non-uniform dimples 502 in the example structure 500 of FIG. 5 has its shallow end (as designated by the arrowhead in the dimple 502 (and which may correspond to the axis direction 102 shown in FIG. 2C)) arranged closest to the geometric center of the cluster (and closest to the geometric center of the central uniform dimple 504). Additionally, each of the interior-most non-uniform dimples 502 in the example structure 500 of FIG. 5 has an immediately adjacent non-uniform dimple 506 that has its symmetric axis 102 aligned with the symmetric axis 102 of its corresponding interior-most non-uniform dimple 502. In the example structure shown in FIG. 5, the shallow ends of the exterior non-uniform dimples 506 are positioned in the opposite direction from the shallow ends of the corresponding interior-most dimples 502 (i.e., with the shallow ends pointing away from the geometric center C of the dimple cluster in this example).

As shown in FIG. 5, the dimple cluster 500 is arranged in a substantially hexagonal pattern (shown by the broken line). The areas between the immediately adjacent dimple sets 502 and 506 in this example cluster 500 are occupied by one or more additional dimples 508, shown grayed in FIG. 5. The dimples 508 may be non-uniform dimples, uniform dimples, or some may be uniform and some non-uniform, without departing from this invention. Thus, this overall dimple cluster 500 contains at least 12 non-uniform dimples 502 and 506 and at least 19 total dimples (although other dimple counts are possible without departing from this invention).

Optionally, if desired, one or more of the pairs of aligned non-uniform dimples 502 and 506 may be flip-flopped such that the shallow end of each non-uniform dimple 502 is located immediately adjacent the shallow end of its corresponding non-uniform dimple 506 (e.g., dimples 502 in FIG. 5 could have the structures and orientations of dimples 506 and dimples 506 in FIG. 5 could have the structures and orientations of dimples 502).

FIG. 6 shows a similar hexagonal dimple cluster arrangement 600 to that shown in FIG. 5, except in the arrangement 600 of FIG. 6, the shallow ends of all the illustrated non-uniform dimples 502 and 506 (shown by the arrowheads) are arranged closest to the geometric center C of the dimple cluster arrangement 600. Likewise, FIG. 7 shows a similar hexagonal dimple cluster arrangement 700 to those shown in FIGS. 5 and 6, except in the arrangement 700 of FIG. 7, the shallow ends of all the illustrated non-uniform dimples 502 and 506 (shown by the arrowheads) are arranged furthest away from the geometric center C of the dimple cluster arrangement 700. The "grayed out" dimples in FIGS. 6 and 7 may be non-uniform dimples, uniform dimples, or some may be uniform and some non-uniform, without departing from this invention. Thus, these overall dimple clusters 600 and 700 contain at least 12 non-uniform dimples 502 and 506 and at least 19 total dimples (although other dimple counts are possible without departing from this invention).

Figure 8:
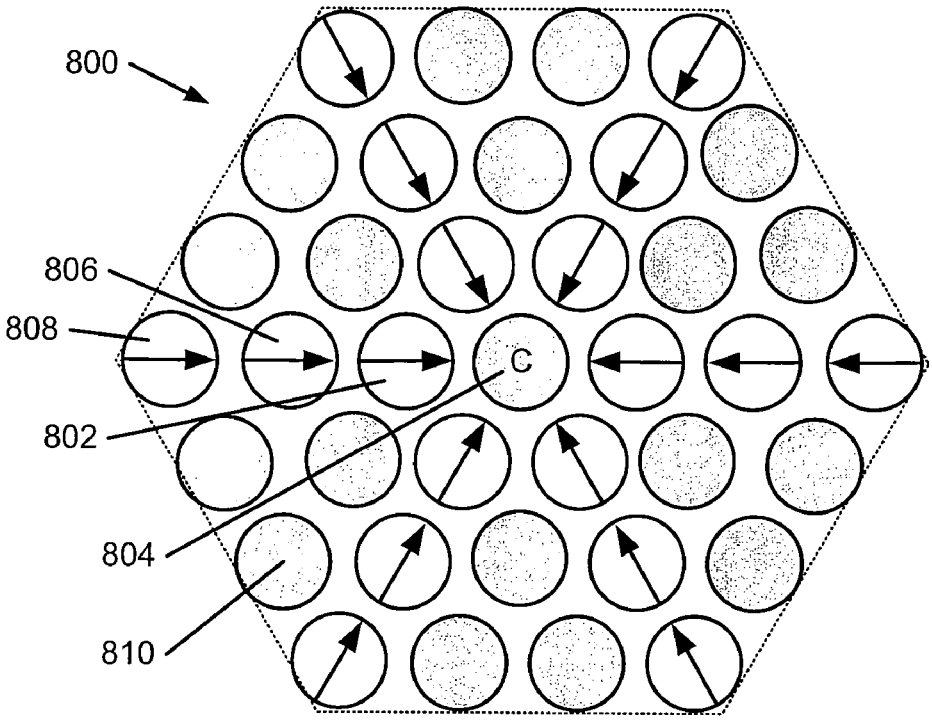
FIG. 8 illustrates another example of a generally hexagonal dimple cluster arrangement in accordance with this invention.

FIG. 8 illustrates another, somewhat larger hexagonal dimple cluster arrangement 800. Like the arrangements shown in FIGS. 5 through 7, the dimple cluster arrangement 800 of FIG. 8 has a series of six non-uniform dimples 802 arranged immediately adjacent one another and surrounding a central dimple 804 (e.g., a uniform or conventional dimple). Each of the interior-most non-uniform dimples 802 in this example structure 800 has its shallow end (as designated by the arrowhead in the dimple 802 (and which may correspond to the axis direction 102 shown in FIG. 2C)) arranged closest to the geometric center of the cluster (and closest to the geometric center of the central uniform dimple 804). Additionally, each of the interior-most non-uniform dimples 802 in the example structure 800 of FIG. 8 has an immediately adjacent non-uniform dimple 806 that has its symmetric axis 102 aligned with the symmetric axis 102 of its corresponding interior-most non-uniform dimple 802. In the example structure shown in FIG. 8, the shallow ends of the non-uniform dimples 806 are aligned in the same direction with the shallow ends of the corresponding interior-most dimples 802 (i.e., with the shallow ends pointing toward the geometric center C of the dimple cluster 800). Additionally, each of the non-uniform dimples 806 in the example structure 800 of FIG. 8 has an immediately adjacent non-uniform dimple 808 that has its symmetric axis 102 aligned with the symmetric axis 102 of its corresponding non-uniform dimples 802 and 806 to make an aligned set of non-uniform dimples 802, 806, and 808. In the example structure shown in FIG. 8, the shallow ends of the exterior non-uniform dimples 808 are aligned in the same direction with the shallow ends of the corresponding non-uniform dimples 802 and 806 within the same line (i.e., with the shallow ends pointing toward the geometric center C of the dimple cluster 800).

If desired, the shallow and deep ends of the various non-uniform dimples 802, 806, and 808 may be aligned and/or oriented in different manners without departing from this invention. As one more specific example, if desired, the aligned dimples 802, 806, and 808 may have their shallow ends located as far as possible from the geometric center C of the dimple cluster 800. As another example, if desired, some sets of the aligned dimples 802, 806, and 808 may have their shallow ends located as far as possible from the geometric center C of the dimple cluster 800 while other sets of aligned dimples 802, 806, and 808 may have their shallow ends located as close as possible to the geometric center C of the dimple cluster 800 (e.g., with one set of shallow ends aligned close and one set of shallow ends align away from the geometric center C in an alternating manner as one moves around the perimeter of the center dimple 804). As yet another example, one or more shallow ends within a set of aligned dimples 802, 806, and 808 may be located close to the geometric center C while one or more of the shallow ends of the other non-uniform dimples within the set may be located away from the geometric center C. Other arrangements of the shallow and deep ends of the non-uniform dimples are possible without departing from this invention.

As shown in FIG. 8, the dimple cluster 800 is arranged in a substantially hexagonal pattern (shown by the broken line). The areas between the immediately adjacent dimple sets 802, 806, and 808 may be occupied by one or more other dimples 810, shown grayed in FIG. 8. The dimples 810 may be non-uniform dimples, uniform dimples, or some may be some combination of uniform and non-uniform dimples, without departing from this invention. Moreover, the dimples 810 on a given ball may have different features (e.g., depth, radius, diameter, profile, etc.) without departing from this invention. Thus, this overall dimple cluster 800 contains at least 18 non-uniform dimples 802, 806, and 808 and at least 24 total dimples (although other dimple counts are possible without departing from this invention).

Figure 9:
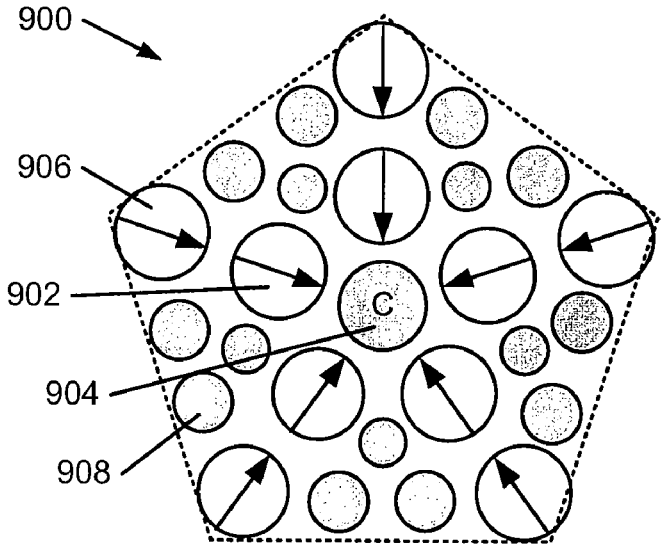
FIG. 9 illustrates an example of a generally pentagonal dimple cluster arrangement in accordance with this invention.

Dimple clusters in accordance with examples of this invention may be arranged in any desired general polygon shape without departing from this invention, including, for example, polygons having from 3 to 12 sides, and in some examples, polygons having from 3 to 10 sides or even from 3 to 8 sides. FIG. 9 illustrates another example dimple cluster arrangement 900 in which a series of five non-uniform dimples 902 are arranged immediately adjacent one another and surrounding a central dimple 904 (e.g., a uniform or conventional dimple). Each of the interior-most non-uniform dimples 902 in this example structure 900 has its shallow end (as designated by the arrowhead in the dimple 902 (and which may correspond to the axis direction 102 shown in FIG. 2C)) arranged closest to the geometric center of the cluster 900 (and closest to the geometric center of the central uniform dimple 904). Additionally, each of the interior-most non-uniform dimples 902 in the example structure 900 of FIG. 9 has an immediately adjacent non-uniform dimple 906 that has its symmetric axis 102 aligned with the symmetric axis 102 of its corresponding interior-most non-uniform dimple 902. In the example structure shown in FIG. 9, the shallow ends of the non-uniform dimples 906 are aligned in the same direction with the shallow ends of the corresponding interior-most dimples 902 (i.e., with the shallow ends pointing toward the geometric center C of the dimple cluster 900). Other alignments and/or arrangements of the shallow and deep ends of the individual dimples 902 and/or 906, including arrangements similar to those shown and described above in conjunction with FIGS. 5-7, may be provided without departing from this invention.

Additionally, if desired, the dimple structure 900 could be expanded to include a third non-uniform dimple aligned with the dimples 902 and 906 shown in FIG. 9 (e.g., akin to the three aligned non-uniform dimple structures 802, 806, and 808 shown in FIG. 8). The shallow and deep ends of these aligned dimples may be arranged in any desired manner (e.g., as described above with respect to FIG. 8) without departing from this invention.

As shown in FIG. 9, the dimple cluster 900 is arranged in a substantially pentagonal pattern (shown by the broken line). The areas between the immediately adjacent dimple sets 902 and 906 may be occupied by one or more other dimples 908, shown grayed in FIG. 9 (three dimples 908 are shown between each immediately adjacent dimple set 902 and 906 in this specific dimple arrangement 900). The dimples 908 may be non-uniform dimples, uniform dimples, or some may be some combination of uniform and non-uniform dimples, without departing from this invention. Thus, this overall dimple cluster 900 contains at least 10 non-uniform dimples 902 and 906 and at least 16 total dimples (although other dimple counts are possible without departing from this invention).

Figure 10A:
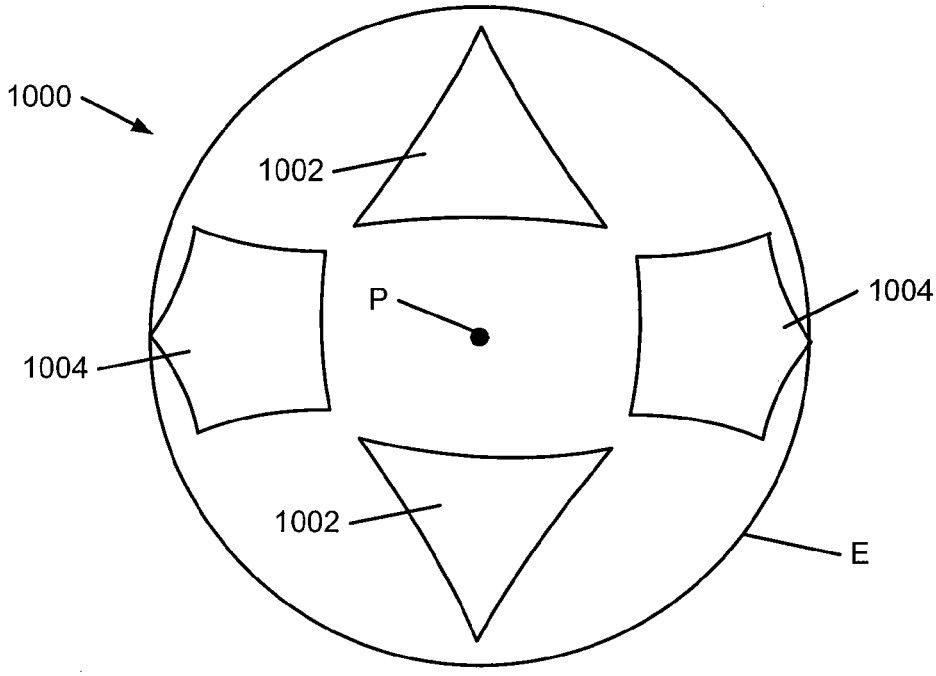
FIGS. 10A through 13B illustrate various examples of non-uniform dimple cluster arrangements on golf ball structures in accordance with this invention.
Figure 10B:
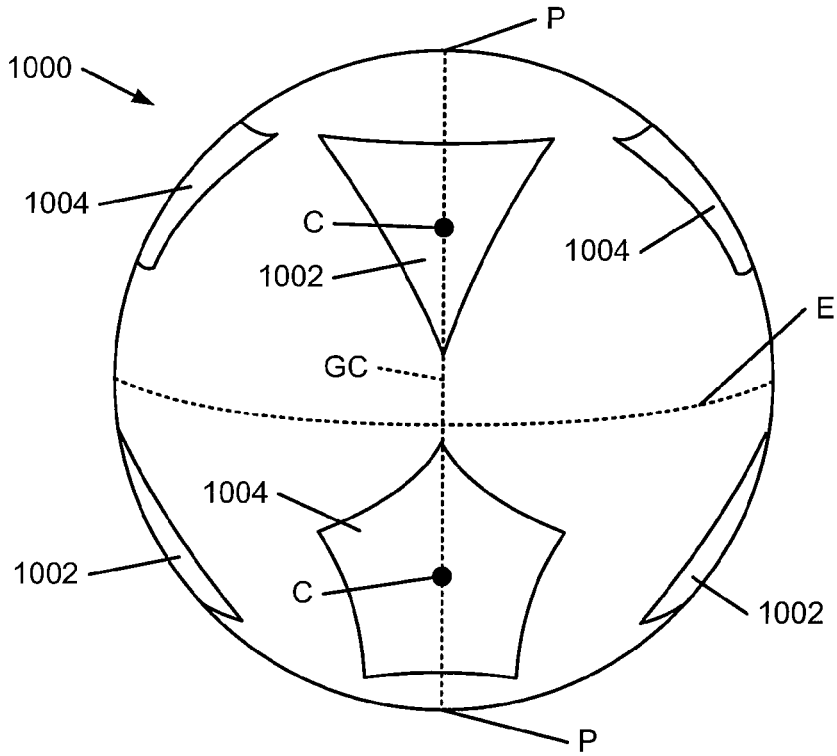

A wide variety of dimple cluster arrangements may be provided on golf ball surfaces without departing from this invention, and each dimple cluster on a given ball structure need not have the same arrangement. FIGS. 10A and 10B illustrate top and front views, respectively, of a golf ball structure 1000 in which two different types of dimple clusters are provided on the ball structure 1000. More specifically, in this illustrated example, the ball includes four generally triangular arrangements 1002 of non-uniform dimples (e.g., like those described above in conjunction with FIGS. 3A through 4B) and four generally pentagonal arrangements 1004 of non-uniform dimples (e.g., like those described above in conjunction with FIG. 9). For purposes of clarity, only the outlines of the dimple clusters 1002 and 1004 are shown in FIGS. 10A and 10B, and the individual dimples, both inside and outside the clusters 1002 and 1004, are not shown. If desired, more or fewer dimple clusters (including additional clusters of different types) may be included on each hemisphere of the ball. Also, while the dimple clusters 1002 and 1004 may be staggered from one another in the two hemispheres (e.g., as shown in FIG. 3D), in this illustrated example ball structure 1000, the two different types of dimple clusters 1002 and 1004 provided around the ball are aligned with one another over the two hemispheres and have their geometric centers C aligned along great circles GC that extend between the two poles P.

Figure 11A:
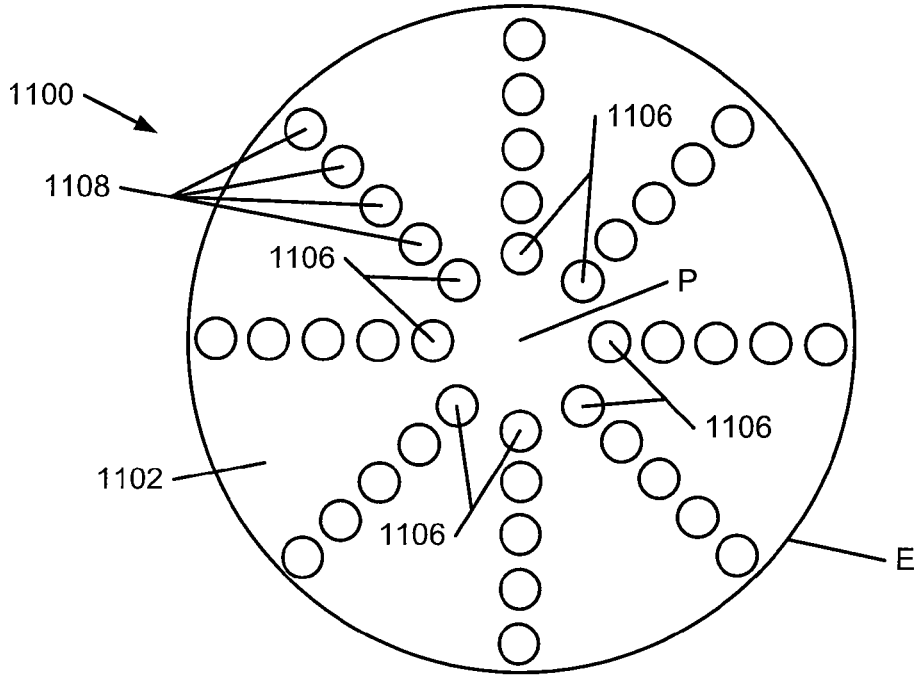
Figure 11B:
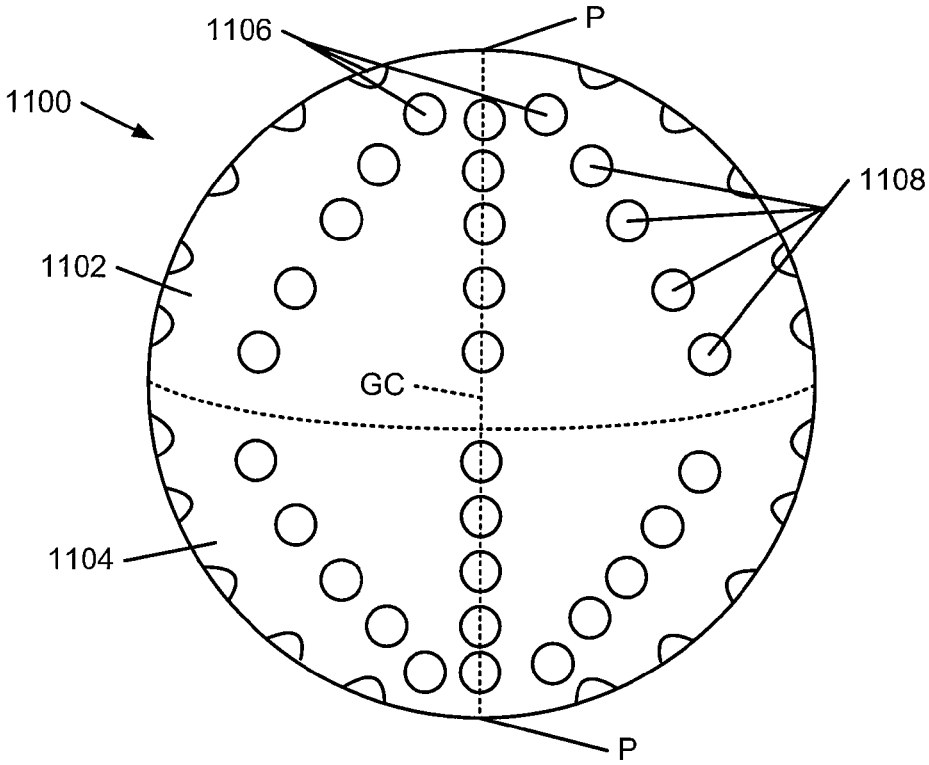

FIGS. 11A and 11B provide top and front views, respectively, of another example arrangement of non-uniform dimple clusters on a golf ball structure 1100. In the structure 1100 shown in FIGS. 11A and 11B, each hemisphere 1102 and 1104 of the ball 1100 has a single (but relatively large) non-uniform dimple cluster. In this example, the cluster includes eight immediately adjacent non-uniform dimples 1106 arranged around the pole P, and each interior-most non-uniform dimple 1106 has four non-uniform dimples 1108 aligned with it and aligned with the pole P. More or fewer non-uniform dimples 1108 may be provided in each linear set of non-uniform dimples 1106 and 1108 without departing from this invention. For purposes of clarity and to better illustrate the non-uniform dimple clusters, other dimples are not shown on the ball structure 1100, although those skilled in the art will recognize that additional dimples (uniform or non-uniform) may be provided in the surface areas between the illustrated non-uniform dimples 1106 and 1108 and over the pole area P. Also, while the dimple clusters are aligned between the two hemispheres 1102 and 1104 in the example structure 1100 shown in FIGS. 11A and 11B (e.g., aligned along a great circle GC extending between the poles P), this is not a requirement. Rather, if desired, the dimple clusters may be staggered such that no great circle connects the dimple clusters in an aligned set in the top hemisphere 1102 with those in the bottom hemisphere 1104.

Figure 12A:
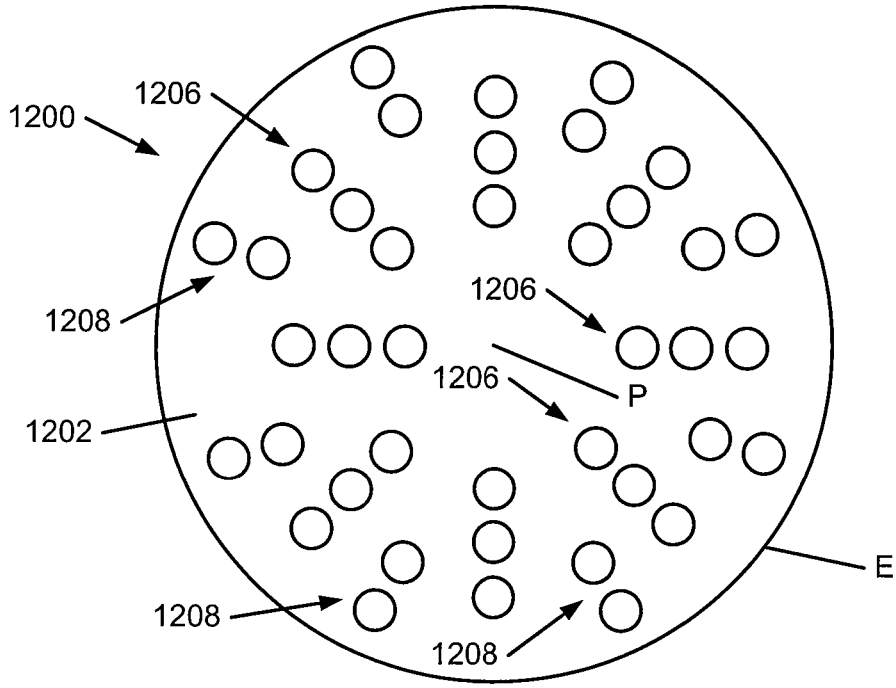
Figure 12B:
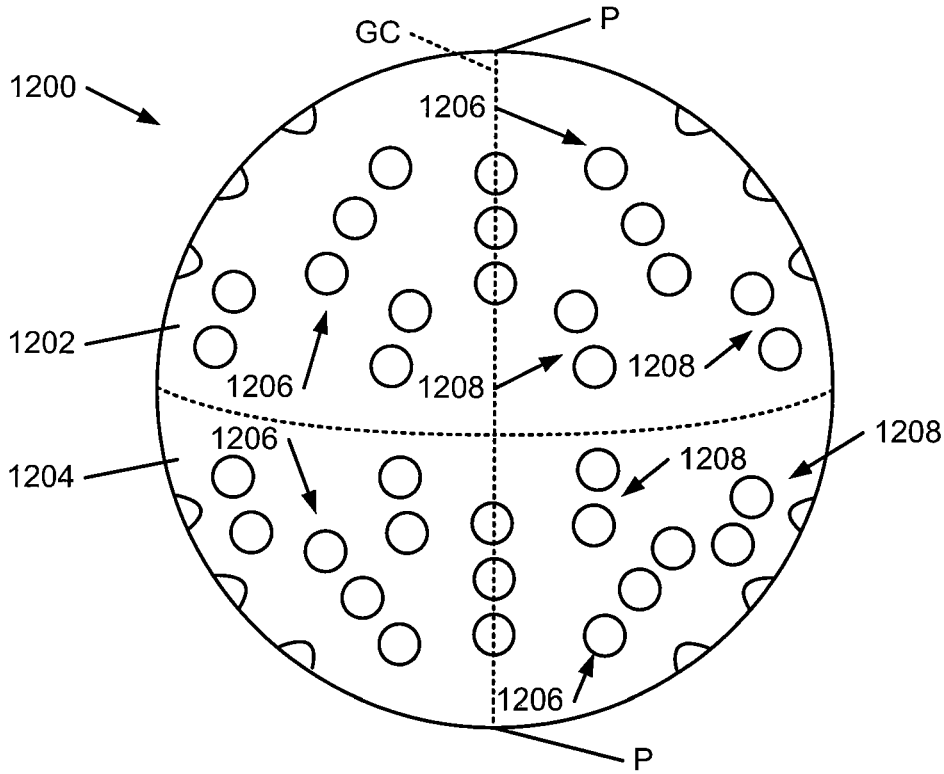

Relatively large and two (or three) dimensional non-uniform dimple clusters are illustrated and described above in conjunction with FIGS. 2A through 11B, but this also is not a requirement. Rather, if desired, the dimple clusters may be relatively small and linear, e.g., including 2 to 10 aligned non-uniform dimples. FIGS. 12A and 12B illustrate top and front views of a golf ball structure 1200, respectively, including such clusters. In the structure 1200 of FIGS. 12A and 12B, each hemisphere 1202 and 1204 contains two different types of non-uniform dimple clusters 1206 and 1208, one cluster type 1206 having three aligned non-uniform dimples and the other cluster type 1208 having two aligned non-uniform dimples. More specifically, in this illustrated example, each hemisphere 1202 and 1204 includes eight 3-non-uniform dimple clusters 1206 and eight 2-non-uniform dimple clusters 1208 (for a total of 40 non-uniform dimples in each hemisphere). For purposes of clarity and to better illustrate the non-uniform dimple clusters, other dimples are not shown on the ball structure 1200, although those skilled in the art will recognize that any desired number and arrangement of additional dimples (uniform or non-uniform) may be provided in the surface areas between the illustrated non-uniform dimple clusters 1206 and 1208. Also, while the dimple clusters 1206 and 1208 are aligned between the two hemispheres 1202 and 1204 in the example structure 1200 shown in FIGS. 12A and 12B (e.g., aligned along a great circle GC extending between the poles P), this is not a requirement. Rather, if desired, the dimple clusters 1206 and 1208 may be staggered between the two hemispheres 1202 and 1204 such that no great circle connects the dimple clusters in the top hemisphere 1202 with those in the bottom hemisphere 1204.

Figure 13A:
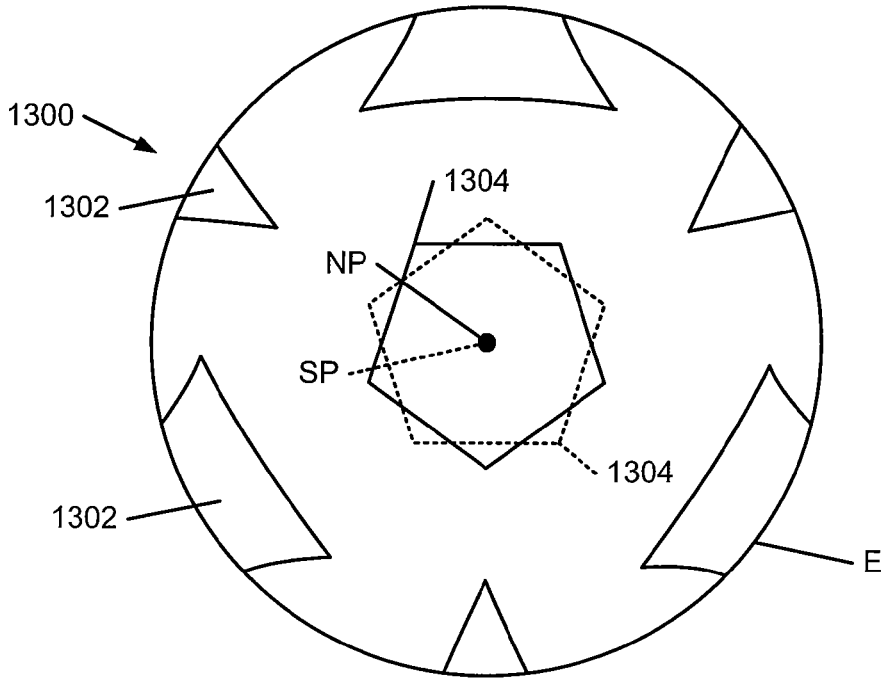
Figure 13B:
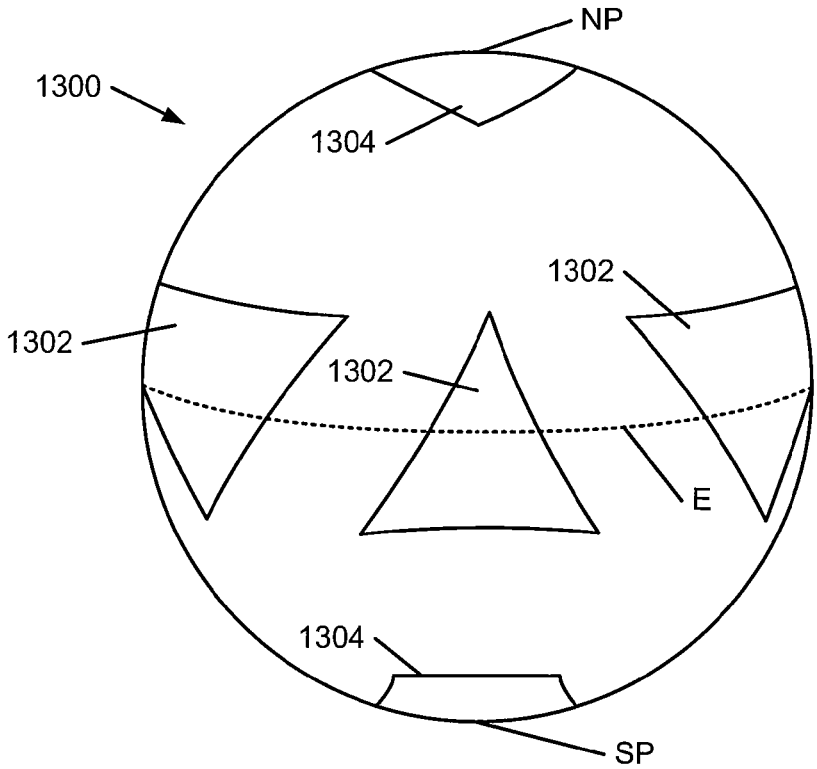

In the various example structures disclosed above, the dimple clusters are arranged on the hemispheres of the ball such that they do not cross the ball's equator (which may correspond to the mold parting line, although the mold parting line need not correspond to the ball's equator, particularly if the ball is of a "seamless" design). This type of arrangement is not a requirement. FIGS. 13A and 13B illustrate top and front views, respectively, of a golf ball structure 1300 in which plural non-uniform dimple clusters 1302 extend across the equator E. While any desired non-uniform dimple cluster pattern(s) may be used without departing from this invention (including plural different patterns on a single ball structure), in this illustrated example structure 1300, the clusters 1302 have a triangular arrangement of non-uniform dimples, e.g., like those described above in conjunction with FIGS. 3A through 4B.

Also, if desired, the pole areas P (shown as the north pole NP and the south pole SP) also may include non-uniform dimple clusters 1304. While the pole oriented non-uniform dimple clusters 1304 may have the same pattern as the equator crossing non-uniform dimple clusters 1302, in the example structure 1300 shown in FIGS. 13A and 13B, the pole oriented non-uniform dimple clusters 1304 differ in pattern from the equator crossing non-uniform dimple clusters 1302. The south pole non-uniform dimple cluster 1304 is shown in broken lines in FIG. 13A, to show the difference in arrangement of the pole oriented dimple clusters 1304 in this example ball 1300. If desired, the north and sole pole patterns may differ from one another.

A variety of non-uniform dimple clusters are described above. The individual non-uniform dimples within a given cluster may all have the same structure and characteristics, but this is not a requirement. Rather, if desired, non-uniform dimples within an individual cluster may have different perimeter sizes (e.g., diameters or other dimensions), different perimeter edge shapes, different depths, different profiles, etc., without departing from this invention.

Additional aspects of this invention relate to methods of producing golf balls of any of the various types described above. Such methods may include, for example: (a) forming a golf ball interior (e.g., including a solid core having one or more independent layers, a thread wound core, a liquid-containing or gel-containing core, etc.); and (b) forming a cover to enclose the golf ball interior, wherein the cover may include, for example, non-uniform dimple clusters, e.g., of the various types described above. The balls may be formed by forming the interior, e.g., by injection molding, other molding techniques, casting, machining and/or otherwise forming one or more layers of a solid core (e.g., for use in making a two, three, four, five, or more piece golf ball construction). The interior of the golf ball may be made of rubber (natural or synthetic), elastomeric resins, or other desired materials (e.g., ionomer resins, thermoplastic materials (such as thermoplastic polyurethanes, etc.) and the like). The ball interior also may be made by casting the various layers of a solid ball, winding a rubber or elastomeric thread around a solid, liquid, or gel containing core, etc. These methods and materials used in making the core or other interior layers of the ball may be conventional and known in the art. Also, the various layers of the solid core or other interior ball constructions may have sizes, properties, constructions, thicknesses, and the like as are conventionally used and known in the art.

The cover layer for the golf ball (including the non-uniform dimple clusters) may be formed in any desired manner without departing from this invention, including in conventional manners that are known and used in the art, such as by casting the cover, by molding the cover (e.g., injection molding), etc. The molds or other structures for forming the cover layer to include the non-uniform dimples may be produced in any desired manner without departing from this invention, including through the use of molding, casting, machining, grinding, or other techniques, including through the use of precision grinding equipment for producing golf ball cover cavities, as are known and used in the art. Such grinding equipment may be computer controlled and programmed to cut the various desired dimple pattern arrangements into the interior cavity of the mold structure, in a manner that is known and conventionally used in the art.

The cover may be made from any desired materials without departing from this invention, such as from thermoplastic polyurethanes, ionomer resins, balata, etc., including materials that are conventionally known and used in the golf ball art. In addition to the non-uniform dimple clusters, such as those described above, the cover layer may have sizes, properties, constructions, thicknesses, and the like, as well as uniform or conventional dimples, as are conventionally used and known in the art.

Figure 14B:
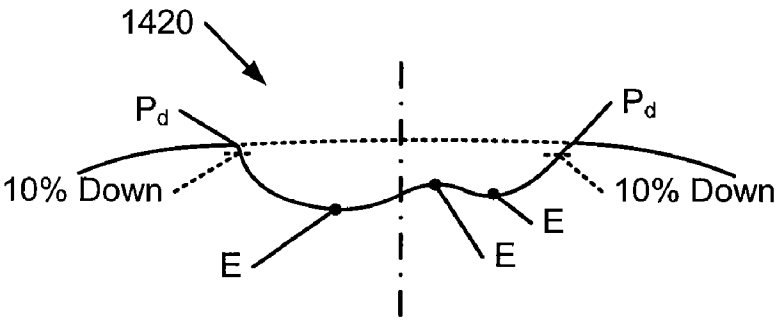
FIGS. 14A and 14B illustrate additional potential features that may be included in non-uniform dimple structures in accordance with at least some examples of this invention.
Figure 14A:
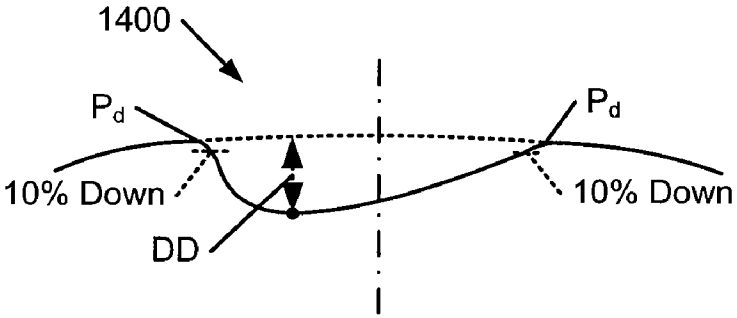

Non-uniform dimples may have a wide variety of specific cross sectional profiles without departing from this invention. For example, if desired, the cross sectional profile may take on the general shape of a portion of a surface of an ellipse, parabola, hyperbola, etc. As additional examples, the shape delineated by the surface of the dimple at the central cross section thereof (e.g., a section taken along the dimple's central symmetric axis 102 as shown in FIG. 2C), or at least over the central part of the dimple away from the dimple perimeter (which may be somewhat rounded, if desired), may correspond to a graphical representation of a mathematical equation, such as a polynomial equation or a polynomial function (e.g., a second order or fourth order polynomial equation or function). FIGS. 14A and 14B illustrate some example cross sectional profiles. For example, as shown in FIG. 14A, the dimple profile 1400 includes a singe local extrema (i.e., the maximum depth point, corresponding to the overall dimple depth DD), and the surface of the cross sectional profile 1400 of the dimple (at least at locations somewhat removed from the immediate dimple perimeter $P_d$, such as areas of the dimple profile below 10% of the overall dimple depth) may correspond to a specific second order mathematical equation or function. The example dimple profile 1420 illustrated in FIG. 14B, on the other hand, includes three local extrema E, and the surface of the cross sectional profile 1420 of the dimple (at least at locations somewhat removed from the immediate dimple perimeter $P_d$, such as areas of the dimple profile below 10% of the overall dimple depth) may correspond to a specific fourth order mathematical equation or function. Above 10% of the overall dimple depth, the dimple may be constructed so that the dimple surface flows smoothly into the cover and outer curvature of the ball, and this smoothing out or curving near the dimple edges may alter the dimple surface at the edges away from the mathematical equation or function described above. The inclusion of more than one local extrema E in a non-uniform dimple profile provides internal surface changes and structure within the dimple pattern and can be used to produce interesting visual and aesthetically pleasing dimple constructions, as well as surfaces to affect the lift, drag, and/or other aerodynamic characteristics of the ball.

CONCLUSION

Many modifications to the specifically described structures, systems, and methods may take place without departing from this invention. For example, while the invention has been described with respect to specific examples including presently preferred modes of carrying out the invention, those skilled in the art will appreciate that there are numerous variations, combinations, and permutations of the above described structures and methods. Moreover, various specific structural features included in the examples merely represent examples of structural features that may be included in some examples of structures according to the invention. Those skilled in the art will understand that various specific structural features may be omitted and/or modified in a golf ball product without departing from the invention. Thus, the reader should understand that the spirit and scope of the invention should be construed broadly as set forth in the appended claims.

I claim:

1. A golf ball comprising:

a core including one or more individual parts; and a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member includes 3-5 repeating non-uniform dimple clusters arranged around the first pole; wherein each non-uniform dimple cluster in the first hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member includes 3-5 repeating non-uniform dimple clusters arranged around the second pole, wherein each non-uniform dimple cluster in the second hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, and wherein the first pattern is a generally hexagonal arrangement containing the non-uniform dimples in the cluster.

2. A golf ball comprising:

a core including one or more individual parts; and a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member includes 3-5 repeating non-uniform dimple clusters arranged around the first pole; wherein each non-uniform dimple cluster in the first hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member includes 3-5 repeating non-uniform dimple clusters arranged around the second pole, wherein each non-uniform dimple cluster in the second hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, and wherein the first pattern is a generally pentagonal arrangement containing the non-uniform dimples in the cluster.

3. A golf ball comprising:

a core including one or more individual parts; and a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member includes 3-5 repeating non-uniform dimple clusters arranged around the first pole; wherein each non-uniform dimple cluster in the first hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member includes 3-5 repeating non-uniform dimple clusters arranged around the second pole, wherein each non-uniform dimple cluster in the second hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, wherein the first pattern is a generally linear alignment of the non-uniform dimples in the cluster, wherein the non-uniform dimples in the generally linear alignment have their respective axes of symmetry aligned, and wherein the first ends of each non-uniform dimple in the generally linear alignment face the same direction.

4. A golf ball comprising:

a core including one or more individual parts; and a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member includes 3-5 repeating non-uniform dimple clusters arranged around the first pole; wherein each non-uniform dimple cluster in the first hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member includes 3-5 repeating non-uniform dimple clusters arranged around the second pole, wherein each non-uniform dimple cluster in the second hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, wherein the first pattern is a generally linear alignment of the non-uniform dimples in the cluster, wherein the non-uniform dimples in the generally linear alignment have their respective axes of symmetry aligned, and wherein the first ends of two immediately adjacent non-uniform dimples in the generally linear alignment face in opposite directions.

5. A golf ball comprising:

a core including one or more individual parts; and a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member includes 3-5 repeating non-uniform dimple clusters arranged around the first pole; wherein each non-uniform dimple cluster in the first hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member includes 3-5 repeating non-uniform dimple clusters arranged around the second pole, wherein each non-uniform dimple cluster in the second hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, wherein the first pattern is a generally linear alignment of the non-uniform dimples in the cluster, wherein the non-uniform dimples in the generally linear alignment have their respective axes of symmetry aligned, and wherein the first ends of two immediately adjacent non-uniform dimples in the generally linear alignment face in the same direction.

6. A golf ball comprising:

a core including one or more individual parts; and a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member includes 3-5 repeating non-uniform dimple clusters arranged around the first pole; wherein each non-uniform dimple cluster in the first hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member includes 3-5 repeating non-uniform dimple clusters arranged around the second pole, wherein each non-uniform dimple cluster in the second hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, and wherein the axes of symmetry of the non-uniform dimples in the first hemisphere are arranged to point toward a geometric center of the dimple cluster in which the non-uniform dimples are contained.

7. A golf ball according to claim 6, wherein the first end of each non-uniform dimple having the axis of symmetry is arranged to be located as close as possible to the geometric center of the dimple cluster in which it is contained.

8. A golf ball according to claim 6, wherein the first end of each non-uniform dimple having the axis of symmetry is arranged to be located as far as possible from the geometric center of the dimple cluster in which it is contained.

9. A golf ball according to claim 6, wherein a first portion of the dimples in a cluster having axes of symmetry are arranged such that their first ends are located as close as possible to the geometric center of the dimple cluster in which they are contained, and wherein a second portion of the dimples in a cluster having axes of symmetry are arranged such that their first ends are located as far as possible from the geometric center of the dimple cluster in which they are contained.

10. A golf ball according to claim 6, wherein one half of the non-uniform dimple clusters are located on the first hemisphere and one half of the non-uniform dimple clusters are located on the second hemisphere.

11. A golf ball according to claim 6, wherein one half of the dimple clusters are symmetrically arranged with respect to the first pole around the first hemisphere and one half of the dimple clusters are symmetrically arranged with respect to the second pole around the second hemisphere.

12. A golf ball according to claim 6, wherein each non-uniform dimple cluster on the cover member has the same pattern.

13. A golf ball according to claim 6, wherein each non-uniform dimple cluster includes from 4 to 30 dimples having a non-uniform dimple profile.

14. A golf ball according to claim 6, wherein each non-uniform dimple cluster includes from 6 to 24 dimples having a non-uniform dimple profile.

15. A golf ball according to claim 6, wherein each non-uniform dimple cluster includes from 8 to 20 dimples having a non-uniform dimple profile.

16. A golf ball according to claim 6, wherein none of the non-uniform dimple clusters extends across the equator.

17. A golf ball according to claim 6, wherein the first hemisphere further includes at least one non-uniform dimple cluster having a second pattern that differs from the first pattern, and wherein the second hemisphere further includes at least one non-uniform dimple cluster having the second pattern.

18. A golf ball comprising:

a core including one or more individual parts; and a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member includes 3-5 repeating non-uniform dimple clusters arranged around the first pole; wherein each non-uniform dimple cluster in the first hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member includes 3-5 repeating non-uniform dimple clusters arranged around the second pole, wherein each non-uniform dimple cluster in the second hemisphere includes from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, wherein one half of the dimple clusters are symmetrically arranged with respect to the first pole around the first hemisphere and one half of the dimple clusters are symmetrically arranged with respect to the second pole around the second hemisphere, and wherein centers of the dimple clusters in the first hemisphere do not align with centers of the dimple clusters in the second hemisphere along any great circle extending between the first pole and the second pole.

19. A method of forming a golf ball, comprising:

forming a core including one or more individual parts; and forming a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member is formed to include 3-5 repeating non-uniform dimple clusters arranged around the first pole; wherein each non-uniform dimple cluster in the first hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member is formed to include 3-5 repeating non-uniform dimple clusters arranged around the second pole, wherein each non-uniform dimple cluster in the second hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, and wherein the first pattern is a generally hexagonal arrangement containing the non-uniform dimples in the cluster.

20. A method of forming a golf ball, comprising:

forming a core including one or more individual parts; and forming a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member is formed to include 3-5 repeating non-uniform dimple clusters arranged around the first pole; wherein each non-uniform dimple cluster in the first hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member is formed to include 3-5 repeating non-uniform dimple clusters arranged around the second pole, wherein each non-uniform dimple cluster in the second hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, and wherein the first pattern is a generally pentagonal arrangement containing the non-uniform dimples in the cluster.

21. A method of forming a golf ball, comprising:

forming a core including one or more individual parts; and forming a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member is formed to include 3-5 repeating non-uniform dimple clusters arranged around the first pole; wherein each non-uniform dimple cluster in the first hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member is formed to include 3-5 repeating non-uniform dimple clusters arranged around the second pole, wherein each non-uniform dimple cluster in the second hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, wherein the first pattern is a generally linear alignment of the non-uniform dimples in the cluster, wherein the non-uniform dimples in the generally linear alignment have their respective axes of symmetry aligned, and wherein the first ends of each non-uniform dimple in the generally linear alignment face the same direction.

22. A method of forming a golf ball, comprising:

forming a core including one or more individual parts; and forming a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member is formed to include 3-5 repeating non-uniform dimple clusters arranged around the first pole; wherein each non-uniform dimple cluster in the first hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member is formed to include 3-5 repeating non-uniform dimple clusters arranged around the second pole, wherein each non-uniform dimple cluster in the second hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, wherein the first pattern is a generally linear alignment of the non-uniform dimples in the cluster, wherein the non-uniform dimples in the generally linear alignment have their respective axes of symmetry aligned, and wherein the first ends of two immediately adjacent non-uniform dimples in the generally linear alignment face in opposite directions.

23. A method of forming a golf ball, comprising:

forming a core including one or more individual parts; and forming a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member is formed to include 3-5 repeating non-uniform dimple clusters arranged around the first pole; wherein each non-uniform dimple cluster in the first hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member is formed to include 3-5 repeating non-uniform dimple clusters arranged around the second pole, wherein each non-uniform dimple cluster in the second hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, wherein the first pattern is a generally linear alignment of the non-uniform dimples in the cluster, wherein the non-uniform dimples in the generally linear alignment have their respective axes of symmetry aligned, and wherein the first ends of two immediately adjacent non-uniform dimples in the generally linear alignment face in the same direction.

24. A method of forming a golf ball, comprising:

forming a core including one or more individual parts; and forming a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member is formed to include 3-5 repeating non-uniform dimple clusters arranged around the first pole; wherein each non-uniform dimple cluster in the first hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member is formed to include 3-5 repeating non-uniform dimple clusters arranged around the second pole, wherein each non-uniform dimple cluster in the second hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, and wherein the axes of symmetry of the non-uniform dimples in the first hemisphere are arranged to point toward a geometric center of the dimple cluster in which the non-uniform dimples are contained.

25. A method according to claim 24, wherein the first end of each non-uniform dimple having the axis of symmetry is arranged to be located as close as possible to the geometric center of the dimple cluster in which it is contained.

26. A method according to claim 24, wherein the first end of each non-uniform dimple having the axis of symmetry is arranged to be located as far as possible from the geometric center of the dimple cluster in which it is contained.

27. A method according to claim 24, wherein a first portion of the dimples in a cluster having axes of symmetry are arranged such that their first ends are located as close as possible to the geometric center of the dimple cluster in which they are contained, and wherein a second portion of the dimples in a cluster having axes of symmetry are arranged such that their first ends are located as far as possible from the geometric center of the dimple cluster in which they are contained.

28. A method according to claim 24, wherein one half of the non-uniform dimple clusters are located on the first hemisphere and one half of the non-uniform dimple clusters are located on the second hemisphere.

29. A method according to claim 24, wherein one half of the dimple clusters are symmetrically arranged with respect to the first pole around the first hemisphere and one half of the dimple clusters are symmetrically arranged with respect to the second pole around the second hemisphere.

30. A method according to claim 24, wherein each non-uniform dimple cluster on the cover member has the same pattern.

31. A method according to claim 24, wherein each non-uniform dimple cluster includes from 4 to 30 dimples having a non-uniform dimple profile.

32. A method according to claim 24, wherein each non-uniform dimple cluster includes from 6 to 24 dimples having a non-uniform dimple profile.

33. A method according to claim 24, wherein each non-uniform dimple cluster includes from 8 to 20 dimples having a non-uniform dimple profile.

34. A method according to claim 24, wherein none of the non-uniform dimple clusters extends across the equator.

35. A method according to claim 24, wherein the first hemisphere further includes at least one non-uniform dimple cluster having a second pattern that differs from the first pattern, and wherein the second hemisphere further includes at least one non-uniform dimple cluster having the second pattern.

36. A method of forming a golf ball, comprising:

forming a core including one or more individual parts; and forming a cover member enclosing the core, wherein the golf ball includes a first pole, a second pole opposite the first pole, and an equator evenly spaced between the first and second poles so as to divide the golf ball body into a first hemisphere including the first pole and a second hemisphere including the second pole, wherein, in the first hemisphere, the cover member is formed to include 3-5 repeating non-uniform dimple clusters arranged around the first pole; wherein each non-uniform dimple cluster in the first hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein, in the second hemisphere, the cover member is formed to include 3-5 repeating non-uniform dimple clusters arranged around the second pole, wherein each non-uniform dimple cluster in the second hemisphere is formed to include from 2 to 36 non-uniform dimples arranged such that each non-uniform dimple in the cluster is located immediately adjacent at least one other non-uniform dimple in the cluster; wherein a majority of the non-uniform dimples in each cluster have an axis of symmetry, a first end centered on the axis of symmetry, and a second end centered on the axis of symmetry; and wherein the first end is deeper than or has a steeper entry angle than the second end, wherein at least one of the 3-5 non-uniform dimple clusters in the first hemisphere is arranged in a first pattern and at least one of the 3-5 non-uniform dimple clusters in the second hemisphere is arranged in the first pattern, wherein one half of the dimple clusters are symmetrically arranged with respect to the first pole around the first hemisphere and one half of the dimple clusters are symmetrically arranged with respect to the second pole around the second hemisphere, and wherein centers of the dimple clusters in the first hemisphere do not align with centers of the dimple clusters in the second hemisphere along any great circle extending between the first pole and the second pole.

* * * * *